US005826724A

United States Patent [19]

Gebhardt

[11] Patent Number: 5,826,724

[45] Date of Patent: Oct. 27, 1998

[54] DOUBLE PERFORATION EASY TEAR-OFF BAG

[75] Inventor: Terry D. Gebhardt, Longview, Tex.

[73] Assignee: TC Manufacturing Co., Inc., Evanston, Ill.

[21] Appl. No.: 851,782

[22] Filed: May 6, 1997

[51] Int. Cl.[6] ..... B65D 30/00

[52] U.S. Cl. ..... 206/554; 206/806; 383/87; 383/209

[58] Field of Search ..... 206/554, 806; 383/9, 87, 207–209, 37, 66

[56] References Cited

U.S. PATENT DOCUMENTS

| | | | |
|---|---|---|---|
| 3,365,100 | 1/1968 | Piazze | 383/209 |
| 4,305,503 | 12/1981 | Membrino | 206/554 |
| 4,406,371 | 9/1983 | Membrino | 206/554 |
| 4,526,565 | 7/1985 | Hummel et al. . | |
| 4,717,262 | 1/1988 | Roen et al. . | |
| 4,769,125 | 9/1988 | Roen et al. . | |
| 4,769,126 | 9/1988 | Roen et al. . | |
| 4,790,803 | 12/1988 | Roen et al. . | |
| 4,838,327 | 6/1989 | Ambler et al. | 383/87 |
| 4,932,560 | 6/1990 | Roen . | |
| 5,205,808 | 4/1993 | Gebhardt . | |
| 5,222,600 | 6/1993 | Stoddard et al. | 383/87 |
| 5,575,393 | 11/1996 | Gebhardt . | |
| 5,658,077 | 8/1997 | Hoftman | 383/87 |

FOREIGN PATENT DOCUMENTS

| | | | |
|---|---|---|---|
| 294354 | 12/1988 | Japan | 383/87 |

*Primary Examiner*—Paul T. Sewell
*Assistant Examiner*—Luan K. Bui
*Attorney, Agent, or Firm*—Lee, Mann, Smith, McWilliams, Sweeney & Ohlson

[57] ABSTRACT

A plastic bag has two perforations, an upper and a lower, and a flip top allowing the top of the bag to be torn from a header or saddle loaded with product and closed. The flip top can then be removed using the lower perforation to expose the product.

7 Claims, 3 Drawing Sheets

DOUBLE PERFORATION EASY TEAR-OFF BAG

FIELD OF THE INVENTION

The present invention generally relates to plastic bags and more specifically, relates to an improved plastic bag that has two perforations and a flip top which allows the user to remove the bag from a header or saddle, flip the top to enclose the items therein and then later, tear off the top to expose the product for use.

BACKGROUND OF THE INVENTION

Plastic bags have become very popular in supermarkets and stores due to their light weight, strength and easy disposability. Additionally, plastic bags have a relatively low cost to manufacture when mass produced. However, users sometimes have problems with plastic bags containing a product when they wish to use or consume the product in that the top of the bag may interfere with consumption. Thus, when an item such as a frozen product or a taco product and similar products are placed in the bag and the user wishes to consume the product while it remains in the bag, the top of the bag or the closure of the bag frequently interferes. Thus, the shape, size and closure of the plastic bag has an impact on how well the bag holds a product and how a product can be consumed.

SUMMARY OF THE INVENTION

It is an object of the present invention to overcome the disadvantages of prior plastic bags by providing a bag that has two perforations and a flip top allowing the top of the bag to be torn off a header or saddle, loaded with product, and then closed with a flip top. Thereafter, the top of the bag may be torn off providing easy access to consume the product with minimal mess.

The bag is made of plastic tubular or sheeting stock and the configuration is either as a header or saddle construction. For the purposes of this description, the explanation will focus on the header configuration, although it will be understood that the bag could be made in a saddle configuration with a pair of bags separated by a header which is to be draped over a bag holder.

BRIEF DESCRIPTION OF THE DRAWINIGS

DETAILED DESCRIPTION OF THE INVENTION

Figure 1:
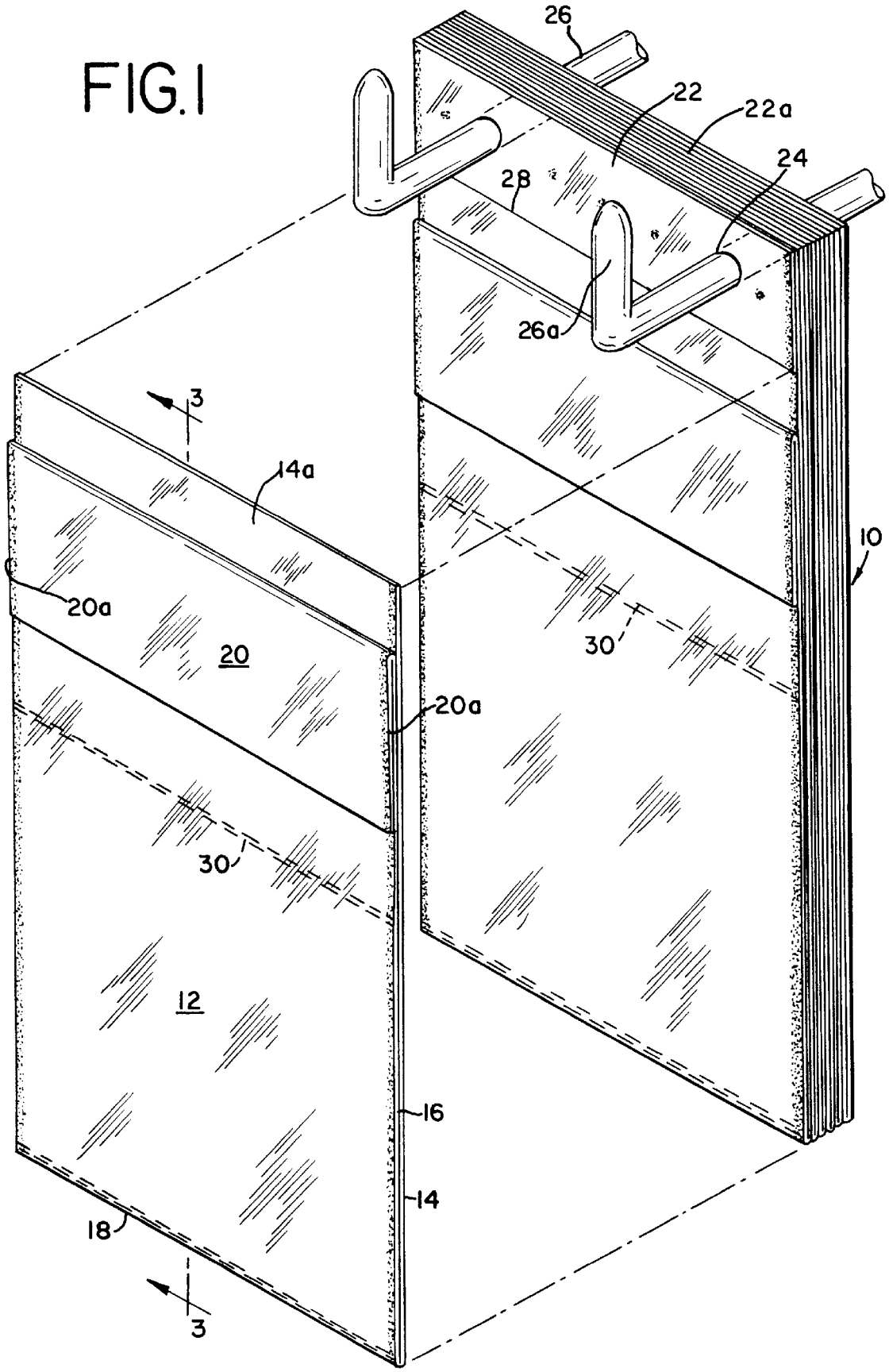
FIG. 1 is an exploded perspective view of the plastic bag of this invention in a header configuration hooked on a holder.
Figure 2:
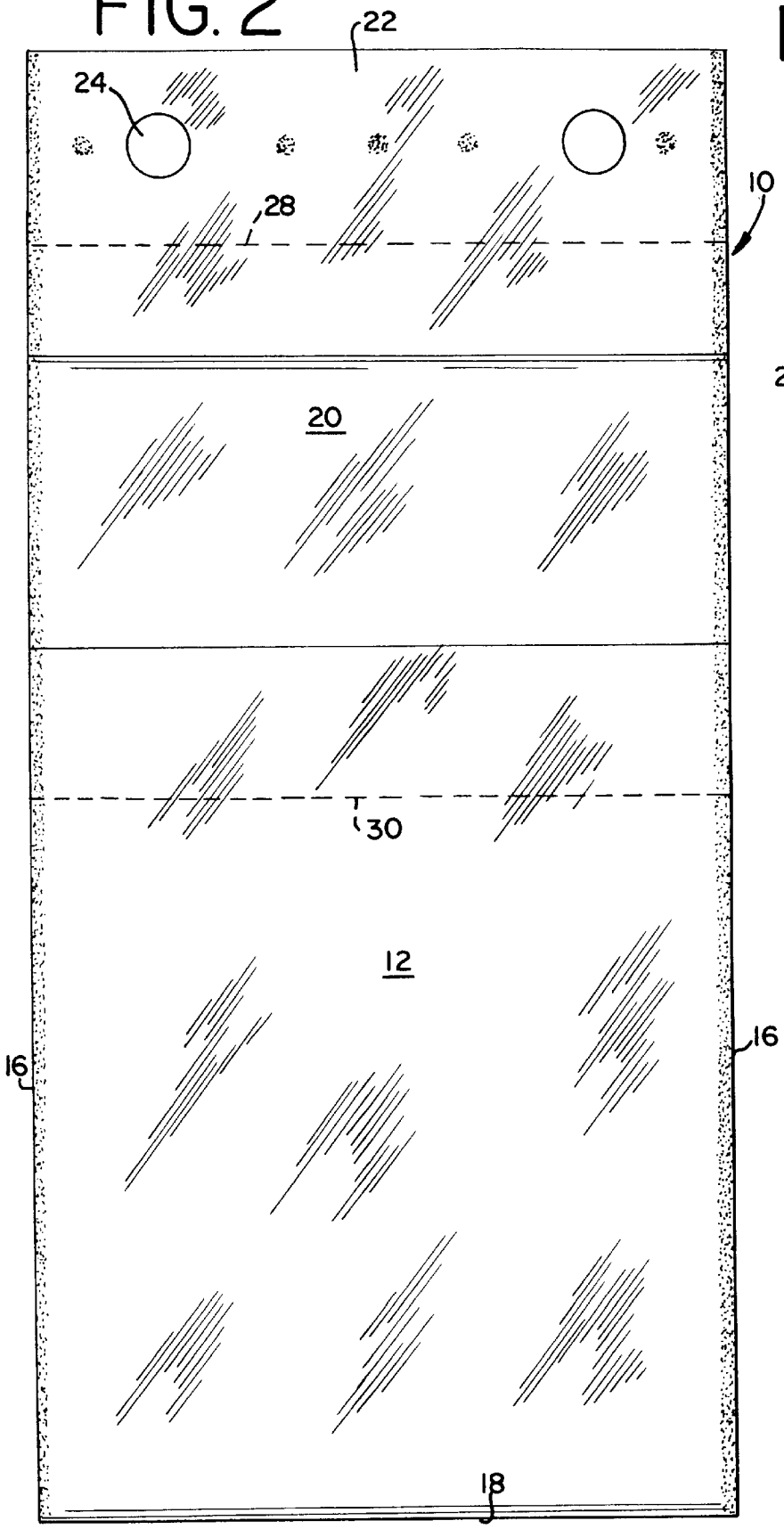
FIG. 2 is a plan view of the plastic bag of this invention.
Figure 3:
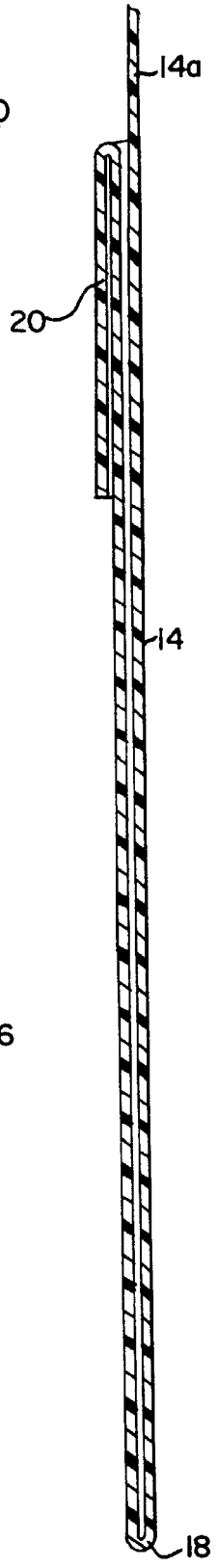
FIG. 3 is a sectional view taken along the lines 3—3 of FIG. 1.
Figure 4:
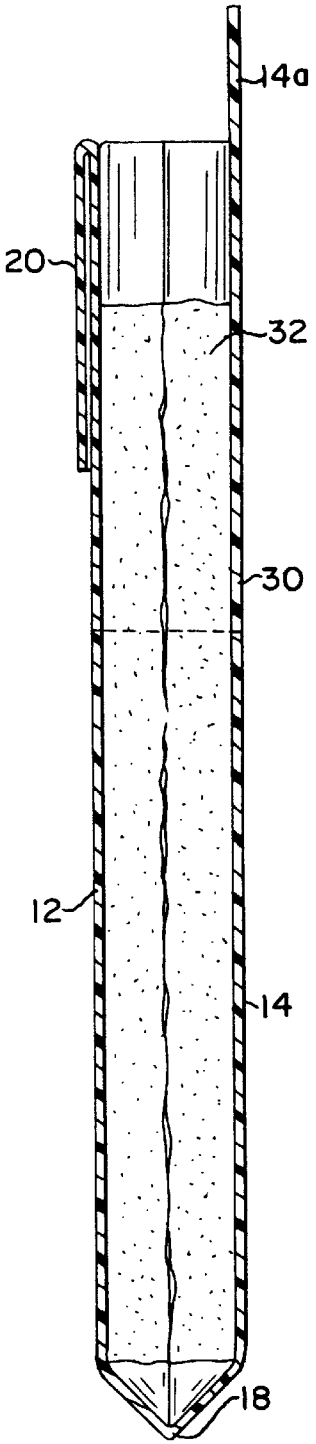
FIGS. 4, 5 and 6 are sectional views similar to FIG. 3 showing the bag with the product inserted therein in FIG. 4; the top flipped over in FIG. 5; and the top removed in FIG. 6.

The plastic bag 10 of this invention as shown in FIGS. 1 and 2 includes a front wall 12 and a back wall 14 which are joined together at the sides 16. The bottom 18 is created by the fold of the plastic material which provides the front wall 12 and the back wall 14. At the top of the front wall 12, is a flip top section 20 which comprises a fold over of the plastic material which is then further joined to the sides 16 at 20*a*. This section 20 provides the flip top of the bag. The back wall of the bag 14 extends upwardly to create the header portion 22. The headers of the bags of the same size and shape, i.e., congruent, are joined together as by heat sealing and the like to provide a pack of bags as indicated at 22*a*. Such a construction can also be made in a saddle pack by extending the back wall 14 of the bag through the header 22 to connect it to a similar bag header to create a saddle. The saddle would then be draped over a conventional holder so that the bags could be removed from either side.

As shown in the construction in FIG. 1, the header is designed to be installed on a holder 26 which has a hooked end 26*a*. The header 22 includes holes 24 which are designed to received the hooks 26*a* to support the header and the bags.

Below the header 22 is a perforation 28 in the back wall 14. This perforation is designed to allow removal of the bag 10 from the header. Below the flip top 20 is a second perforation 30. Thus, the bag incorporates two perforations 28 and 30 and a flip top 20. The two perforations 28 and 30 are the bag-to-header perforation 28 for bag separation from the header 22 and the body perforation 30 for separating the top of the bag after it has been loaded and secured with the flip top 20. These two perforations 28 and 30 in conjunction with the flip top 20 allow the bag to accept a product 32 be separated from the header 22, closed with the flip top 20 and given to the consumer where the bag 10 is then opened for use of the product 32 by tearing off the top portion 34. This exposes the product 32, for example, a frozen product, a taco-like product, or any other kind of product that would extend upwardly from the bag for consumption. It should be understood that the bag may be used for any kind of product and is not limited.

Figure 5:
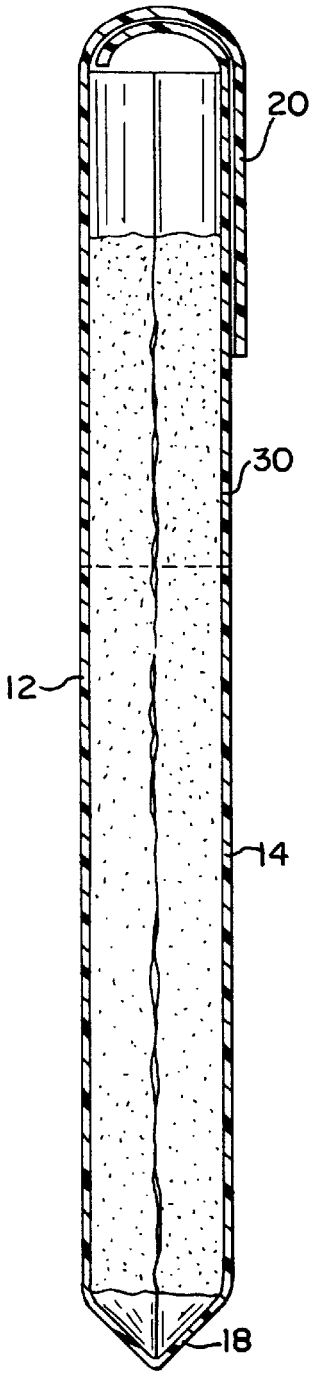
Figure 6:
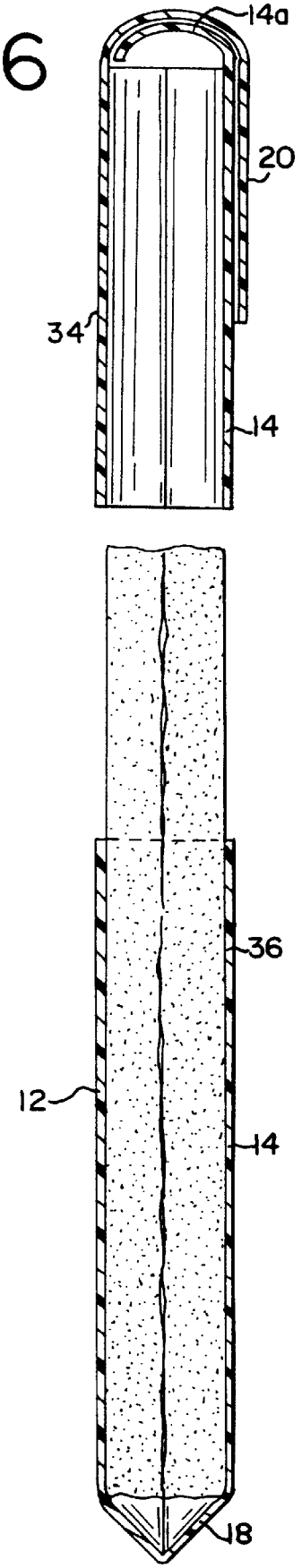

Going back to the use of the flip top 20, it will be noted that the back wall 14 extends above the top perforation 28 at 14*a*. This section of the back wall 14*a* is designed to be folded over the product and then the flip top 20 is flipped over the product as shown in FIG. 5. This provides a very reliable seal of the product 32 in the bag 10 of this invention.

The configuration of the perforations 28 and 30 is such that the force needed to separate the header perforation 28 will not separate the body perforation 30. The body perforation 30 also has sufficient strength to allow the closure of the flip top 20 without separating. To separate the perforation 30, the consumer will grasp either side of the perforation and pull it apart. This does not take excessive force and will not tear the bag. The product is then exposed for consumption while leaving the lower portion of the product 32 in the bottom portion 36 of the bag to contain any product spillage. The perforation specification, i.e., the perforations per square inch, in the perforations 28 and 30 is determined by the film gauge of the plastic material and the weight of the product it is designed to contain. Both the header and body perforations 28 and 30 have the same perforation specification. Each perforation location has a difference in the number of layers of film which changes the perforation force. The body perforation 30 has two layers of film while the header perforation 28 has only one. This allows the amount of force necessary to separate the header perforation 28 to be less than the body perforation 30.

The body perforation 30 is located below the flip top 20 on the upper portion of the bag 10. This allows the bag top 34 to be removed as opposed to the bottom 36 leaving the product 32 in a totally sealed, leak-proof portion of the bag. Bag 10 does not require any type of sealing when closed to contain the product 32. This is accomplished by the back wall extension 14*a* which is folded over the product 32 and the flip top 20. The flip top 20 is of sufficient size to fold over the top of the bag and the product to form a cover that prevents the product 32 from slipping out once loaded and secured.

In summary, the dual perforations allow the bag 10 to be loaded and separated from the header 22 or separated from the header 22 and then loaded with product 32. Either way, the bag is secured without the second perforation separating. The consumer ends up with a package that is secured by the flip top but is easily opened by separating the body perforation 30. This perforation exposes the top of the product while leaving the bottom of the product covered. Thus, no mess from product juices or crumbs.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A plastic bag pack including a plurality of bags joined together at the top to provide a header, each bag comprising:

a) a front wall and a rear wall joined together at their sides and bottom to provide said bag;

b) said rear wall having a portion extending upwardly to provide a section attached to said header;

c) said front wall including at the top thereof a turned over portion joined at the sides to the sides of said bag to provide a flip top for said bag;

d) a first perforation in said rear wall top portion; and e) a second perforation in said front and rear walls below said flip top;

whereby said bag can be removed from said header along said first perforation, said flip top can cover and protect product in said bag and said top can be removed along said second perforation to expose said product for use.

2. The plastic bag pack of claim 1 wherein the force necessary to rupture said second perforation is greater than the force necessary to rupture said first perforation.

3. The plastic bag pack of claim 2 wherein the force necessary to invert the top portion to provide a flip top for said bag is less than the force necessary to rupture said second perforation.

4. The plastic bag pack of claim 1 wherein said header is joined to a second plastic bag pack to provide a saddle bag construction of bag packs.

5. The plastic bag pack of claim 1 wherein said header is provided with means for supporting said plastic bag pack.

6. The plastic bag pack of claim 1 wherein said rear wall section is adapted to be folded over product in said bag prior to the closure of said flip top.

7. A plastic bag designed to be joined through its rear wall to a header comprising:

a) a front wall and a rear wall joined together at their sides and bottom to provide said bag;

b) a first perforation in said rear wall adjacent said header;

c) a second perforation in said front and rear walls below the top of said bag;

d) said second perforation being so constructed that the force necessary to rupture said second perforation is greater than the force necessary to rupture said first perforation.

* * * * *